US010272670B2

(12) United States Patent
Byun et al.

(10) Patent No.: US 10,272,670 B2
(45) Date of Patent: Apr. 30, 2019

(54) INK JETTING APPARATUS WITH MULTI-NOZZLES

(71) Applicant: Enjet Co. Ltd., Suwon-si, Gyeonggi-do (KR)

(72) Inventors: Do Young Byun, Seoul (KR); Vu Dan Nguyen, Suwon-si (KR)

(73) Assignee: Enjet Co. Ltd., Suwon-si (KR)

( * ) Notice: Subject to any disclaimer, the term of this patent is extended or adjusted under 35 U.S.C. 154(b) by 0 days.

(21) Appl. No.: 15/843,050

(22) Filed: Dec. 15, 2017

(65) Prior Publication Data

US 2019/0061351 A1 Feb. 28, 2019

(30) Foreign Application Priority Data

Aug. 22, 2017 (KR) ..... 10-2017-0106118

(51) Int. Cl.
*B41J 2/045* (2006.01)
*B41J 2/06* (2006.01)
*B41J 2/145* (2006.01)

(52) U.S. Cl.
CPC ..... *B41J 2/04526* (2013.01); *B41J 2/06* (2013.01); *B41J 2/145* (2013.01)

(58) Field of Classification Search
CPC .... B41J 2002/02; B41J 2/04526; B41J 2/095; B41J 2/08
See application file for complete search history.

(56) References Cited

U.S. PATENT DOCUMENTS 4,224,523 A * 9/1980 Crean ..... B41J 2/08 250/396 R
8,573,757 B2 * 11/2013 Desai ..... B41J 2/03 347/73
2011/0075161 A1 * 3/2011 Byun ..... B41J 2/06 358/1.8
2011/0134195 A1 * 6/2011 Kim ..... B41J 2/04576 347/71
2011/0285792 A1 * 11/2011 Byun ..... B41J 2/06 347/54
2013/0293619 A1 11/2013 Tunmore et al.
2016/0175856 A1 * 6/2016 Paschkewitz ..... B29C 64/112 427/562

FOREIGN PATENT DOCUMENTS

KR 10-2014-0036414 3/2014
KR 10-2014-0059013 5/2014

* cited by examiner

*Primary Examiner* — Shelby L Fidler
(74) *Attorney, Agent, or Firm* — Berggren LLP

(57) ABSTRACT

The present disclosure relates to an ink jetting apparatus with multi-nozzles, the apparatus including a liquid droplet generating unit configured to generate liquid droplets from ink and jet the liquid droplets through the multi-nozzles, and an evaporation control unit configured to guide the liquid droplets jetted from the multi-nozzles to protect the liquid droplets from thermal and physical disturbance and control evaporation of the liquid droplets.

15 Claims, 5 Drawing Sheets

INK JETTING APPARATUS WITH MULTI-NOZZLES

PRIORITY

This application claims priority of Korean application number 10-2017-0106118 filed on Aug. 22, 2017, and the contents of which is incorporated herein by reference.

BACKGROUND

Field

The present disclosure relates to an ink jetting apparatus with multi-nozzles, and more particularly, to an ink jetting apparatus with multi-nozzles, capable of discharging liquid droplets in drop-on-demand method through the multi-nozzles and controlling evaporation of the liquid droplets, thereby forming smaller liquid droplets than when discharging the liquid droplets, to form a micro-fine line width pattern.

Description of Related Art

Most ink jetting apparatuses configured to jet fluid in the form of liquid droplets used to be applied to inkjet printers in the past, but recently, they are being widely applied and used in high-tech industries such as in processes for manufacturing displays, processes for manufacturing printed circuit boards, processes for manufacturing DNA chips and the like.

Ink jetting apparatuses are largely classified into drop-on-demand method apparatuses and continuous inkjet method apparatuses. Piezoelectric inkjet method and thermal bubble inkjet method are known as the main methods of the drop-on-demand method.

The aforementioned conventional ink jetting technologies have limitations in forming liquid droplets of not more than 20 to 30 micrometers, and thus these technologies also have limitations in the line-width being patterned.

Hybrid type inkjet technologies where the electrostatic inkjet method is added is well-known for realizing fine line widths, but such technologies only reduce the size of the liquid droplets by only about 30% compared to the general size of liquid droplets basically formed.

Further, although it is known that piezoelectric method inkjet technologies can form liquid droplets in the size of picoliters and discharge liquid droplets of about 20 micrometers, there are problems that the liquid droplets fail to hit a targeted place on the substrate since the piezoelectric method inkjets cannot secure linearity due to external disturbance while the liquid droplets are flying towards a substrate.

SUMMARY

Therefore, a purpose of the present disclosure is to resolve the aforementioned problems of prior art, that is to provide an ink jetting apparatus with multi-nozzles, while the liquid droplets discharged through the multi-nozzles using the piezoelectric inkjet method, thermal bubble inkjet method, or electrostatic jet method, that are drop-on-demand methods, or a hybrid method where the aforementioned methods are combined pass through an evaporation control unit, being capable of controlling evaporation and flying direction of the liquid droplets, thereby forming micro-fine liquid droplets and improving the degree of precision of hitting.

Tasks to be solved by the present disclosure are not limited to the aforementioned tasks, and other tasks not mentioned herein should be clearly understandable by a person skilled in the art from the disclosure hereinbelow.

The aforementioned purpose may be achieved by an ink jetting apparatus with multi-nozzles according to the present disclosure, the apparatus including a liquid droplet generating unit configured to generate liquid droplets from ink and jet the liquid droplets through the multi-nozzles; and an evaporation control unit configured to guide the liquid droplets jetted from the multi nozzles to protect the liquid droplets from thermal and physical disturbance and control evaporation of the liquid droplets.

Here, the liquid droplet generating unit may preferably jet the liquid droplets in drop-on-demand method.

Here, the liquid droplet generating unit may be formed as any one of an inkjet head of piezoelectric inkjet method, an inkjet head of thermal bubble method, and an inkjet head of electrostatic inkjet method.

Here, the liquid droplet generating unit may be formed in a hybrid method that is combined with an electrostatic jet method that generates the liquid droplets using a force of an electric field caused by a voltage being applied to an electrode formed in an ink chamber or an ink supply tube of an inkjet head of piezoelectric method or an inkjet head of thermal bubble method.

Here, the liquid droplet generating unit may further include an ejection electrode which is arranged in a position spaced apart from the multi-nozzles in a direction in which the liquid droplets are jetted, has a through-hole where the liquid droplets jetted from the multi-nozzles penetrate and are discharged, and is configured to generate the electric field with the applied voltage to generate the liquid droplets from the ink.

Here, a ground electrode may be formed in the ink chamber or the ink supply tube of the inkjet head of piezoelectric inkjet method or the inkjet head of thermal bubble method.

Here, the apparatus may further include, between the multi-nozzles and the ejection electrode, a first spacer that forms a path where the liquid droplets move.

Here, the ejection electrode may be branched off for each separate nozzle constituting the multi-nozzles so that the voltage is controlled separately.

Here, the evaporation control unit may include a second spacer that forms a path guiding the liquid droplets jetted from the liquid droplet generating unit; and a focusing electrode which is arranged below the second spacer, has a through-hole for discharging the liquid droplets that passed through the second spacer, and is configured to allow the liquid droplets to be focused to a center of the through-hole and discharged using a voltage applied.

Here, the evaporation control unit may have a plurality of sets comprising the second spacer and the focusing electrode formed in a direction in which the liquid droplets are jetted.

Here, a size of the voltage being applied to the focusing electrode may be controlled to increase along the direction in which the liquid droplets are jetted.

Here, the focusing electrode may be branched off for each separate nozzle constituting the multi-nozzles so that the voltage is controlled separately.

Here, the evaporation control unit may further include a heating unit for heating the evaporation control unit.

Here, the heating unit may heat the focusing electrode.

Here, the heating unit may be formed as an electric heating plate arranged below the focusing electrode.

Here, the heating unit may be branched off for each separate nozzle constituting the multi-nozzles to be controlled separately.

Here, the apparatus may further include, between the liquid droplet generating unit and the evaporation control unit, a heat shield for shielding heat generated from the heating unit.

Here, the apparatus may further include a gas supply unit for supplying gas to an inside of the first spacer to focus the liquid droplets to a center of the path.

Here, the gas may be supplied to the inside of the first spacer through a gas supply channel of a structure being branched off from the gas supply unit.

As aforementioned, an ink jetting apparatus with multi-nozzles according to the present disclosure has an advantage of allowing the liquid droplets being jetted from the multi-nozzles to pass through the evaporation control unit, so that the flying distance of the liquid droplets can be controlled and the liquid droplets can be evaporated while the liquid droplets pass through the evaporation control unit, to form micro-fine liquid droplets, thereby realizing micro-fine line widths of not more than 1 micrometer.

Further, the ink jetting apparatus with multi-nozzles according to the present disclosure has another advantage of controlling the flying direction of the liquid droplets having electric charges through a focusing electrode, thereby increasing the degree of precision of hitting.

Further, the ink jetting apparatus with multi-nozzles according to the present disclosure has another advantage of further improving the degree of precision of hitting substrate by the gas being supplied on the flying path of the liquid droplets by the gas supply unit.

Further, the ink jetting apparatus with multi-nozzles according to the present disclosure has another advantage of controlling the environment such as temperature, humidity, concentration of chemical species and the like in the area being patterned by the gas being supplied to the gas supply unit.

Further, the ink jetting apparatus with multi-nozzles according to the present disclosure has another advantage of controlling each separate nozzle to have a different form of jetting by controlling the ejection electrode and/or focusing electrode and/or heating unit separately for each separate nozzle.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present between two elements. Like reference numerals refer to like elements throughout.

DETAILED DESCRIPTION

Figure 1:
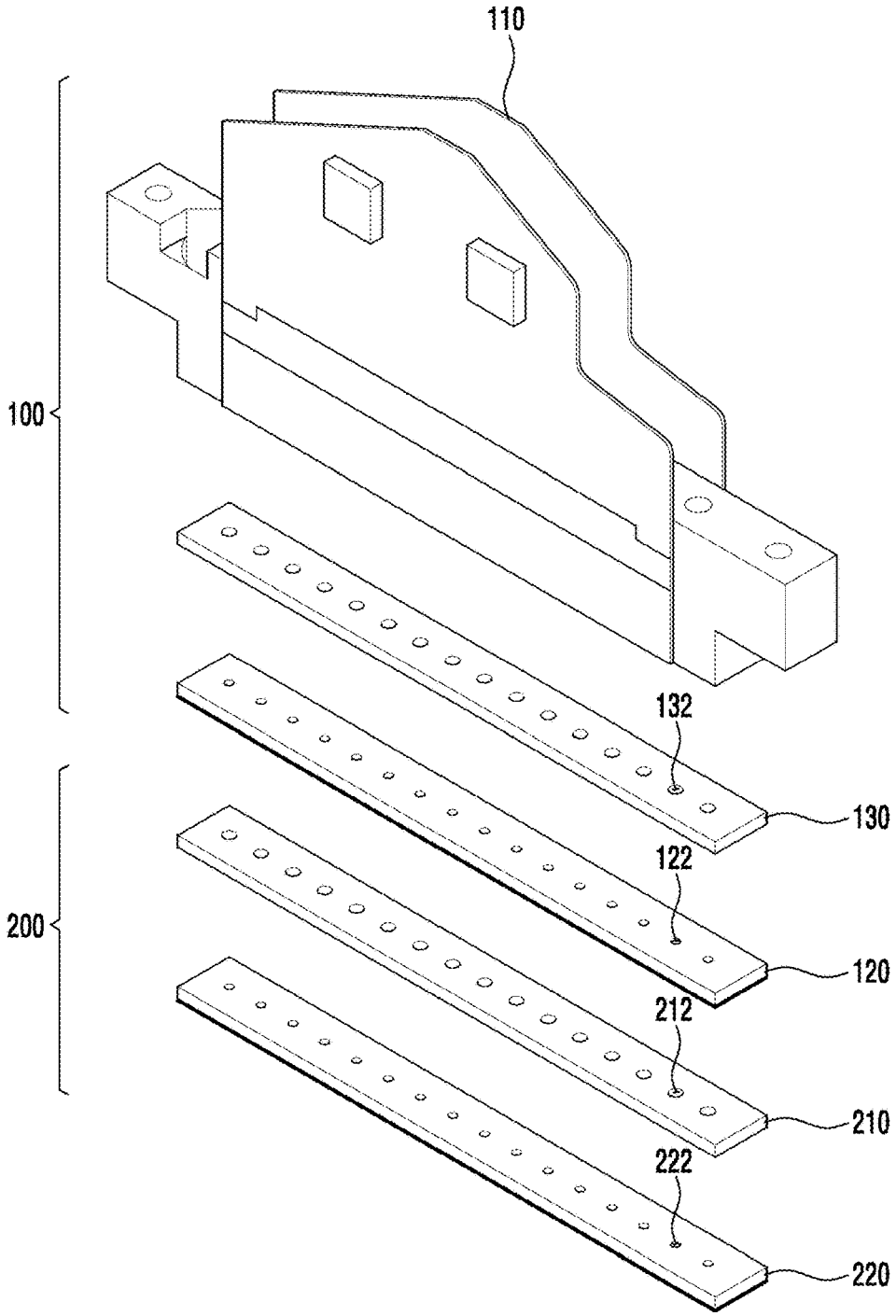
FIG. 1 is an exploded perspective view schematically illustrating an ink jetting apparatus with multi-nozzles according to an embodiment of the present disclosure.

Specific matters of the embodiments are included in the detailed description and the drawings.

Advantages and characteristics of the present disclosure, and methods for achieving those advantages and characteristics will become clear with reference to the embodiments described in detail hereinbelow together with the drawings attached. However, the present disclosure is not limited to the embodiments disclosed hereinbelow, but may be realized in various different forms, and thus these embodiments are provided in order to complete the disclosure of the present disclosure and to have a person skilled in the art to completely understand the scope of the present disclosure, and the present disclosure shall only be defined by the scope of the claims. Throughout the entirety of the specification, like reference numerals indicate like component elements.

Hereinbelow, the present disclosure will be described with reference to the drawings provided to describe an ink jetting apparatus with multi-nozzles according to the embodiments of the present disclosure.

Figure 2:
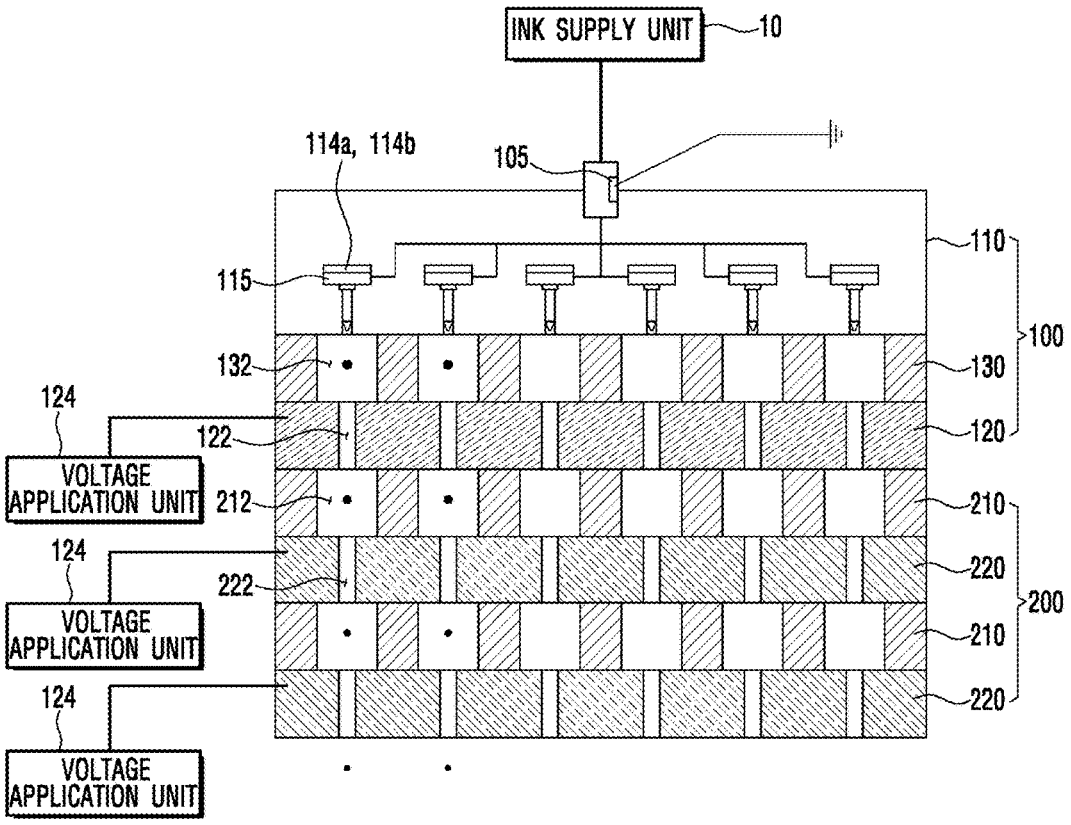
FIG. 2 is a cross-sectional view schematically illustrating an ink jetting apparatus with multi-nozzles according to an embodiment of the present disclosure.
Figure 3:
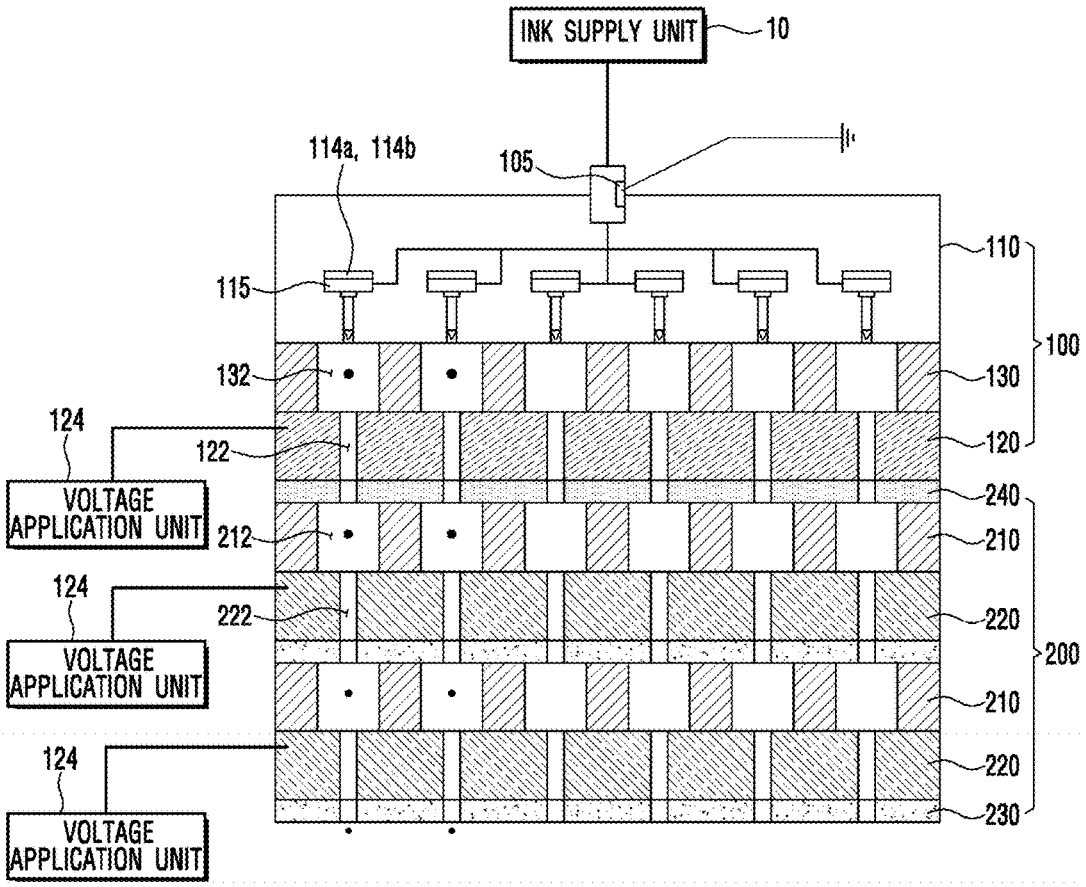
FIG. 3 is a cross-sectional view schematically illustrating an ink jetting apparatus with multi-nozzles according to another embodiment of the present disclosure.
Figure 4:
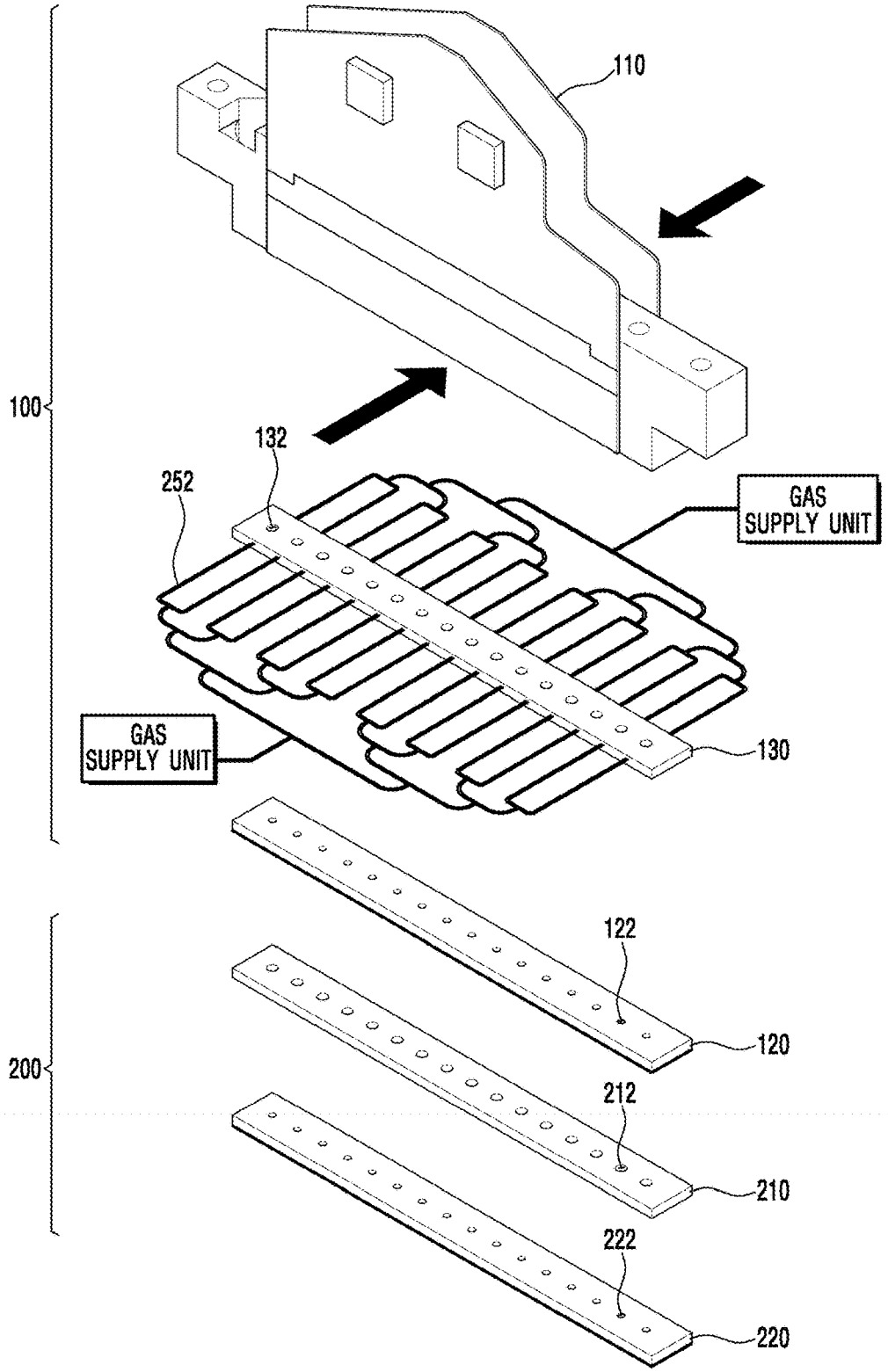
FIG. 4 is a view illustrating how gas is supplied from outside to an ink jetting apparatus with multi-nozzles of FIG. 1.
Figure 5:
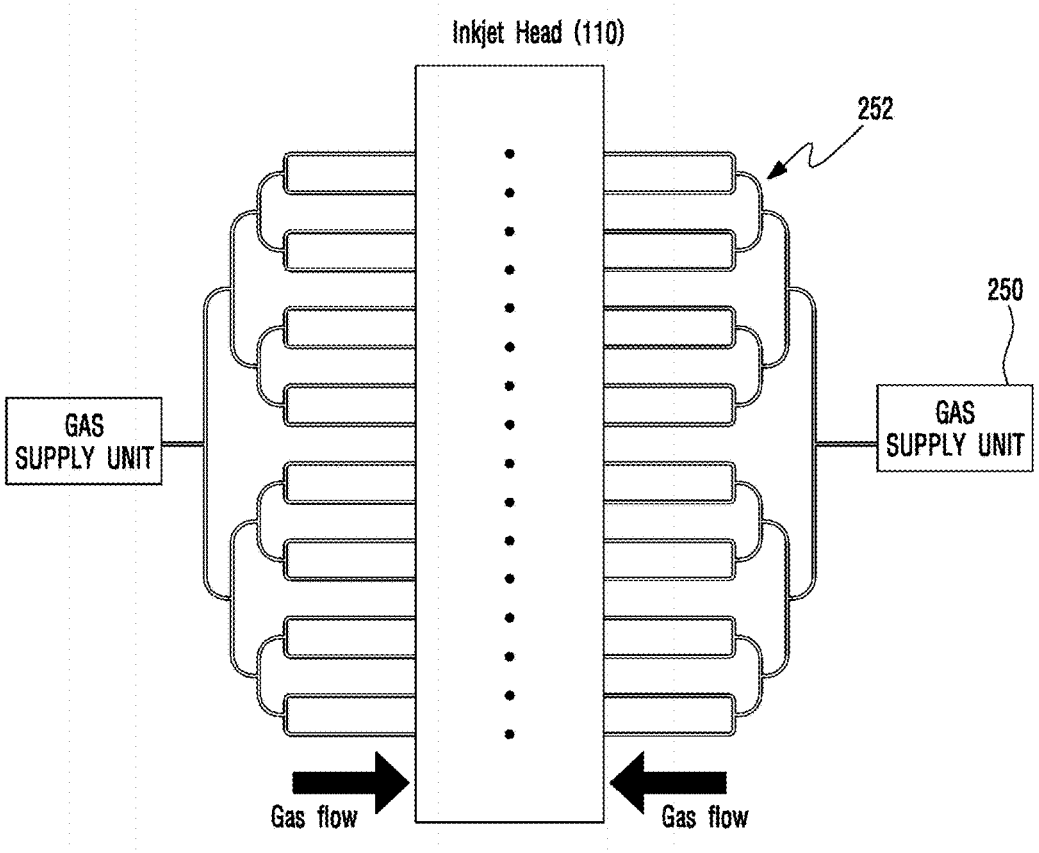
FIG. 5 illustrates a gas supply channel that supplies gas to an ink jetting apparatus with multi-nozzles, through a gas supply unit.

FIG. 1 is a exploded perspective view schematically illustrating an ink jetting apparatus with multi-nozzles according to an embodiment of the present disclosure, FIG. 2 is a cross-sectional view schematically illustrating an ink jetting apparatus with multi-nozzles according to an embodiment of the present disclosure, FIG. 3 is a cross-sectional view schematically illustrating an ink jetting apparatus with multi-nozzles according to another embodiment of the present disclosure, FIG. 4 is a view illustrating how gas is supplied from outside to an ink jetting apparatus with multi-nozzles of FIG. 1, and FIG. 5 illustrates a gas supply channel that supplies gas to an ink jetting apparatus with multi-nozzles, through a gas supply unit.

The ink jetting apparatus with multi-nozzles according to an embodiment of the present disclosure may be configured to include a liquid droplet generating unit 100, and an evaporation control unit 200.

The liquid droplet generating unit 100 generates liquid droplets from ink, and jets the liquid droplets through the multi-nozzles 112. In the present disclosure, the liquid droplet generating unit 100 may be formed as an inkjet head 110 of the conventional piezoelectric inkjet method, thermal bubble inkjet method, or electrostatic jet method, or a hybrid method of the aforementioned methods combined, but there is no limitation thereto, and thus any other well-known method may be used as long as it can discharge liquid droplets in the drop-on-demand method. Otherwise, the liquid droplet generating unit may form the liquid droplets in a continuous inkjet method. The liquid droplets being generated in the aforementioned methods are discharged through the multi-nozzles 112 and transferred to the evaporation control unit 200, and by evaporation performed in this evaporation control unit 200, the size of the liquid droplets may be controlled. Here, the evaporation of the liquid droplets may be controlled by natural evaporation while the liquid droplets are flying, and may also be controlled by evaporation caused by heat transfer from an external energy source, which will be explained in detail hereinafter.

Hereinafter, the present disclosure will be explained based on an assumption that the liquid droplet generating unit 100 is configured, for example, in a hybrid method.

As illustrated in FIG. 2, the ink being supplied from an ink supply unit 10 to the inside of the inkjet head 110 is branched off and supplied to each separate nozzle 112 constituting the multi-nozzles 112. Here, each separate nozzle 112 may be provided with a piezoelectric actuator 114*a* or a thermal bubble heater 114*b*. In the case of discharging liquid droplets by providing a jetting force to the ink being supplied to the inside of a chamber 115 of the separate nozzle 112 by the piezoelectric actuator 114*a*, the inkjet head 110 may be inkjet head of a piezoelectric inkjet method, and in the case of discharging liquid droplets by providing a jetting force to the ink with the pressure of bubble generated by heating the ink being supplied to the chamber 115 of the separate nozzle 112 by the thermal bubble heater 114*b*, the inkjet head 110 may be inkjet head of a thermal bubble inkjet method.

Further, the liquid droplet generating unit 100 may further include an ejection electrode 120 and a spacer 130. The ejection electrode 120 is arranged in a position spaced apart from the multi-nozzles 112 in the direction in which the liquid droplets are jetted, and a through-hole 122 is formed where the liquid droplets being jetted from each separate nozzle 112 of the multi-nozzles 112 pass through.

Here, as illustrated in FIGS. 1 and 2, the ejection electrode 120 is formed such that the aforementioned through-hole 122 is formed in a single electrode plate, and that a common voltage is applied to the multi-nozzles 112 by a voltage application unit 124, but there is no limitation to the form of the ejection electrode 120, and thus the ejection electrode 120 may be separated per separate nozzle 112 and formed separately. Here, the form in which the liquid droplets are jetted from each nozzle 112 may be separately controlled by separately applying a voltage to each separated ejection electrode 120.

Here, a spacer 130 that mutually spaces apart the multi-nozzles 112 and the ejection electrode 120 may be formed between the multi-nozzles 112 and the ejection electrode 120.

The spacer 130 is provided with a plurality of holes 132 formed on a plate having a certain thickness, such that the liquid droplets discharged from the multi-nozzles 112 can pass through.

As aforementioned, the liquid droplet generating unit 100 further includes the ejection electrode 120 and the spacer 130, thereby constituting an inkjet head of a hybrid method, that is an inkjet head of the piezoelectric inkjet method to which the electrostatic jet method has been added, or an inkjet head of a hybrid method, that is an inkjet head of the thermal bubble inkjet method to which the electrostatic jet method has been added. When the liquid droplets are discharged in the aforementioned hybrid method, smaller liquid droplets may be generated and discharged as compared to the liquid droplets being discharged in the piezoelectric inkjet method or the thermal bubble inkjet method.

Here, an electrode 105 may be formed in a path of the ink, extending from the ink supply unit 10 to each separate nozzle 112 or in a certain position inside the inkjet head 110 in order to apply a certain voltage or to have the electrode 105 grounded. In the case of generating liquid droplets using the piezoelectric actuator 114*a* or the thermal bubble heater 114*b*, the voltage additionally applied to the ejection electrode 120 to obtain the effects of the electrostatic jet method may cause malfunction, and thus it is preferable that the electrode 105 is connected to be grounded.

Although not illustrated herein, in order to guarantee the conditions for generating liquid droplets of a uniform size of a desired frequency in the drop-on-demand method, a sensor for monitoring the temperature or viscosity of the ink may be attached inside the liquid droplet generating unit 110.

The evaporation control unit 200 may guide the liquid droplets jetted from multi-nozzles 112, protect the liquid droplets from thermal and physical external disturbance and control evaporation of the liquid droplets, to generate micro-fine liquid droplets.

The evaporation control unit 200 may be configured to include a spacer 210 and a focusing electrode 220.

The spacer 210 may have the form of a plate having a certain thickness formed below the liquid droplet generating unit 100, and the spacer 210 may be provided with a plurality of holes 212 forming paths through which the liquid droplets being discharged from the through-hole 222 of the ejection electrode 120 above the spacer 210 move.

The focusing electrode 220 may be formed below the spacer 210 and form through-holes 222 where the liquid droplets being introduced from holes 212 of the spacer 210 pass through. Further, from the voltage application unit 224, a voltage may be applied to the focusing electrode 220 to control the velocity and direction of the liquid droplets having electric charges.

For example, in the case of applying a voltage of 1 kV to the ejection electrode 120 to discharge the liquid droplets from the nozzle 112, a greater voltage may be applied to the focusing electrode 220 (as will be explained hereinafter, a plurality of focusing electrodes 220 may be formed along the branching path of the liquid droplets, where it is preferable to control the voltage such that the size of the voltage being applied to each focusing electrode 220 gradually increases, such as to 1.1 kV, 1.2 kV and the like along the branching path of the liquid droplets), thereby generating a force of electric field that pulls the liquid droplets more intensely.

Therefore, it is possible to increase the velocity of the liquid droplets in the straight direction, and control the liquid droplets to be focused to a center of the through-hole 222 of the focusing electrode 220 as the velocity increases.

In the present disclosure, an automatic voltage control method by a computer program may be used to control the ejection electrode 120 and the focusing electrode 220, and since discharging and transferring of ink liquid droplets are performed at a very short period of time, in order to control such discharging, it is preferable to use a pulse that is longer than the period of time that the liquid droplets pass through each electrode to apply the voltage.

Evaporation of the liquid droplets being discharged from the liquid droplet generating unit 100 is proceeded according to the following relationship formula:

$$D^2 = k \times time$$

(Here, D is the diameter of the liquid droplets, k is the evaporation rate of the liquid droplets and time is the lapsed time)

K is the evaporation rate ($cm^2$/sec) of the liquid droplets, that is a constant that varies depending on the type and conditions of the liquid droplets. For example, in the case of a certain solvent, k may be about $10^{-5}$ $cm^2$/sec, in which case, if the size of the liquid droplets that are initially discharged is 100 μm, it may take 10 seconds until the liquid droplets are evaporated, whereas if the size of the liquid droplets that are initially discharged is 10 μm, it may take 0.1 second until the liquid droplets are evaporated.

Therefore, by controlling the length of the flying path of the liquid droplets formed in the spacer 210 and the focusing electrode 220 below the liquid droplet generating unit 100, the size of the liquid droplets may be controlled by evaporation. The length of the flying path of the liquid droplets may be controlled by controlling the thickness of the spacer 210 or the focusing electrode 220, and if necessary, as illustrated in FIG. 2, a plurality of sets constituting the spacer 210 and the focusing electrode 220 may be formed along the jetting path of the liquid droplets, to control the flying path.

Here, the smaller the size of the liquid droplets becomes by evaporation, the smaller the inertial force by the flying of the liquid droplets becomes, and the more affected by disturbance from outside, and thus the liquid droplets may not hit a targeted position on the substrate. In order to control this, a voltage may be applied to the focusing electrode 220 as aforementioned to form an electric field, and by this electric field, the liquid droplets may be controlled to be focused to the center of the through-hole 222 of the focusing electrode 220 and move.

In the case of functional liquid droplets, electric charges accumulate in the evaporating process, and thus the flying path of the liquid droplets may be controlled by the voltage being applied to the focusing electrode 220 through the electric field. Further, in the process where the jetted liquid droplets pass through and fly along the through-hole 222 of the focusing electrode 220 to which the voltage is applied, induced electric charges are formed on the surface of the liquid droplets, and the flying path of the liquid droplets may be controlled by controlling the electric field of the focusing electrode 220 continuously formed along the jetting path of the liquid droplets.

Here, as illustrated in FIGS. 1 and 2, the focusing electrode 220 may be provided in the form where the aforementioned through-holes 222 are formed on a single electrode plate, allowing a common voltage to be applied to the multi-nozzles 112, but the form of the focusing electrode 220 is not limited thereto, but may be separated per separate nozzle 112 and formed separately. By separately applying a voltage to each separated focusing electrode 220, the form in which the liquid droplets are jetted may be controlled separately for each nozzle 112.

Further, in the present disclosure, as illustrated in FIG. 3, the evaporation control unit 200 may further include a heating unit 230 and a heat shield 240.

The heating unit 230 heats the evaporation control unit 200 that includes the spacer 210 and the focusing electrode 220, thereby enforcing the evaporation by heat together with natural evaporation of the liquid droplets. Here, the heating unit 230 may be arranged to be adjacent to the focusing electrode 220 so as to heat the focusing electrode 220. For example, as illustrated, an electric heating plate having the form of a film may be provided below the focusing electrode 220 to heat the focusing electrode 220. There is no limitation to the configuration of the heating unit 230, that is, the heating unit 230 may be configured in various forms as long as it can heat the focusing electrode 220 such as by using thermal conduction, radiant heat and the like.

Here, the focusing electrode 220 may be made of a material having high thermal conductivity such as aluminum or copper. As the focusing electrode 220 is made of a material having high thermal conductivity as aforementioned, when heat is applied to the heating unit 230, the focusing electrode 220 may be heated to a uniform temperature. Otherwise, the focusing electrode 220 may be made of a noncorrosive material such as stainless steel. Otherwise, the focusing electrode 220 may be made of a material having high emissivity so that thermal energy being emitted to the focusing electrode 220 can be well absorbed. For example, the focusing electrode 220 may be made of a black color electrode that is anodized, or an electrode of another dark color. Otherwise, the focusing electrode 220 may be made of another metal material or a material with low thermal conductivity such as ceramic material. Otherwise, the focusing electrode 220 may be made of any one of stainless steel, polyimide, polyester, vinyl and polystyrene; and polyethylene terephthalate.

Further, just as the ejection electrode 120 and the focusing electrode 220 mentioned above, the heating unit 230 may be configured separately for each nozzle 112 constituting the multi-nozzles 112 so that can be controlled separately for each nozzle 112.

The heat shield 240 is formed between the liquid droplet generating unit 100 and the evaporation control unit 200, to prevent the heat generated from the heating unit 230 from being transferred to other structures including the liquid droplet generating unit 100.

Here, the heat shield 240 may be made of a material having low heat transfer rate. For example, the heat shield 240 may be made of ceramic, aerogel material, metal having a low heat transfer rate and the like. Otherwise, the heat shield 240 may be made of a material having a structure with low heat transfer rate such as a tubular stainless steel structure. Otherwise, the heat shield 240 may be made of a thermoelectric heat pump or a Peltier Cooler, so that heat being supplied from one side by electric energy can be discharged to the other side.

Further, as illustrated in FIGS. 4 and 5, the present disclosure may further include a gas supply unit 250 for supplying gas along the jetting paths of liquid droplets formed in the evaporation control unit 200.

Preferably, the gas supply unit 250 may allow gas to flow along the path where the liquid droplets move through the spacer 130 placed above the ejection electrode 120. Here, by the gas being supplied, the flying direction of the liquid droplets being jetted through the nozzle 112 may be controlled. Gas that moves along the path inside the evaporation control unit 200 may form a laminar flow, and focus the liquid droplets to a center of the path together with the control on the electric field by the aforementioned focusing electrode 220. When gas is being supplied through the internal path, the velocity distribution of the gas has a parabolic distribution where, at the center of the path, the gas has a high velocity, but at the edge of the path, the gas has a relatively low velocity. Such a velocity distribution may guide the liquid droplets flowing inside the path to flow along the center of the path.

Further, environment conditions such as temperature, humidity, concentration of chemical species and the like in the area being patterned on the substrate may be controlled by the gas being supplied from the gas supply unit 250.

The gas being supplied by the gas supply unit 250 may be a gas kind such as air, nitrogen, argon and the like, but there is no limitation thereto. Otherwise, water vapor gas that is vaporized from water may be supplied, and may then be mixed with the gas kind to control the humidity. Otherwise, the gas may be gas vaporized from the solvent (for example, ethanol) included in the liquid droplets, or gas mixed with the aforementioned gas kind.

Here, a hole (not illustrated) may be formed at a front or rear portion of the focusing electrode 220 so that some of the gas can be exhausted. By such a hole, the flow of velocity of the gas may be controlled, thereby minimizing the effect being made by the flow of the gas when the liquid droplets hit the substrate.

As illustrated in FIG. 5, a gas supply channel 252 that supplies gas from the gas supply unit 250 to the inside may be formed in a continuously branched structure. By such a structure, it is possible to supply gas of the same flow of velocity having a uniform flow rate and a uniform viscosity loss to each separate nozzle 112 constituting the multi-nozzles.

Hereinafter, operations of the aforementioned ink jetting apparatus with multi-nozzles according to the present disclosure will be explained with reference to FIGS. 1 to 5.

First, examples of the ink (printing material) that may be used in the present disclosure include all kinds of organic and inorganic materials where solid particles, surfactants, polymers and the like are dispersed in a solvent. Operations for jetting a functional material for example, are as follows.

By dispersing a conductive or semiconductive nano structure body in a solvent together with a high molecular compound and printing the same, and then performing thermal or photosetting thereon, it is possible to secure characteristics of an electrode. The structure of the nano structure body may be nano particles or one-dimensional nano structure body, the one-dimensional nano structure body preferably being at least one of a nano wire, nano rod, nano pipe, nano belt and nano tube structure. Further, the conductive nano structure body is preferably a nano structure body or a carbon nanotube made of one or more selected from a group consisting of gold (Au), silver (Ag), aluminum (Al), nickel (Ni), zinc (Zn), copper (Cu), silicon (Si) and titanium (Ti), or a combination thereof.

The high molecular compound is characterized to be at least one of a natural high molecular compound or a composite high molecular compound, the natural high molecular compound preferably being at least one of chitosan, gelatin, collagen, elastin, hyaluronic acid, cellulose, silk fibroin, phospholipids and fibrinogen, and the composite high molecular compound preferably being at least one of PLGA (Poly(lactic-co-glycolic acid)), PLA(Poly(lactic acid)), PHBV(Poly(3-hydroxybutyrate-hydroxyvalerate), PDO(Polydioxanone), PGA(Polyglycolic acid), PLCL(Poly(lactide-caprolactone)), PCL(Poly(ecaprolactone)), PLLA(Poly-L-lactic acid), PEUU(Poly(ether Urethane Urea)), Cellulose acetate, PEO(Polyethylene oxide), EVOH(Poly(Ethylene Vinyl Alcohol), PVA(Polyvinyl alcohol), PEG(Polyethyleneglycol) and PVP(Polyvinylpyrrolidone).

First, ink is branched off and supplied to a chamber 115 of the separate nozzle 112 in the liquid droplet generating unit 100 from the ink supply unit 10, and the branched off and supplied ink is discharged from each nozzle 112 in the drop-on-demand method. Here, the liquid droplet generating unit 100 may be configured as the inkjet head 110 of the piezoelectric inkjet method for generating liquid droplets using the piezoelectric actuator 114*a* or as the inkjet head 110 of the thermal bubble inkjet method for generating liquid droplets using the thermal bubble heater 114*b*. Otherwise, the liquid droplet generating unit 110 may be configured as the inkjet head of the hybrid method where a jetting force of the electrostatic jet method has been added to the aforementioned piezoelectric inkjet method or to the thermal bubble inkjet method by further incorporating the aforementioned ejection electrode 120 and the spacer 130, but there is no limitation thereto as long as the liquid droplets can be discharged in the drop-on-demand method.

The liquid droplets being jetted from each nozzle 112 of the liquid droplet generating unit 100 are naturally evaporated in the process where they fly along the evaporation control unit 200 consisting of the spacer 210 and the focusing electrode 220 formed below the liquid droplet generating unit 100, thereby decreasing the size of the liquid droplets.

Here, the evaporation may be controlled by controlling the flying distance of the liquid droplets by controlling the thickness of the spacer 210 and/or the focusing electrode 220. Further, it is possible to provide a plurality of sets consisting of the spacer 210 and the focusing electrode 220 along the flying direction of the liquid droplets to control the flying distance of the liquid droplets, thereby controlling the evaporation.

Further, it is possible to further provide a heating unit 230 configured to heat the focusing electrode 220, to force the evaporation by heat together with the natural evaporation, thereby improving the evaporation efficiency. Here, the heating unit 230 may be formed as an electric heating plate having the form of a film, below the focusing electrode 220, so as to heat the focusing electrode 220 in the form of thermal conduction, but there is no limitation to the configuration and form of the heating unit 230.

Further, a voltage may be applied to the focusing electrode 220. The flying velocity of the liquid droplets may be increased by pulling the liquid droplets having electric charges more intensely using the force of the electric field caused by the voltage being applied, thereby controlling the liquid droplets to be focused to the center of the through-hole 222 of the focusing electrode 220 as the velocity increases.

Here, the focusing electrode 220 may be provided in plural number along the flying path of the liquid droplets, and it is preferable to control the size of the voltage being applied to each focusing electrode 220 such that a stronger force of the electric field can be generated along the flying path.

In the present disclosure, the ejection electrode 120, the focusing electrode 220 and the heating unit 230 may be controlled such that the multi-nozzles 112 are integrated and a common voltage is applied thereto, but the ejection electrode 120, the focusing electrode 220 and the heating unit 230 may be separately formed and separately controlled for each separate nozzle 112 constituting the multi-nozzles 112, thereby separately controlling the form in which the liquid droplets are jetted for each nozzle 112.

Further, in the present disclosure, by supplying gas on the path where the liquid droplets fly, through the evaporation control unit 200, the degree of precision of hitting of the liquid droplets may be further improved. The gas may serve as a carrier that moves the liquid droplets and at the same time guide the liquid droplets to flow along the center of the path by flow focusing.

In the drawings and specification, there have been disclosed typical embodiments of the invention, and although specific terms are employed, they are used in a generic and descriptive sense only and not for purposes of limitation. It will be understood by those of ordinary skill in the art that various changes in form and details may be made therein without departing from the spirit and scope of the present invention as defined by the following claims.

REFERENCE NUMERALS

10: INK SUPPLY UNIT
100: LIQUID DROPLET GENERATING UNIT

105: ELECTRODE
110: INKJET HEAD
112: NOZZLE
114*a*: PIEZOELECTRIC ACTUATOR
114*b*: THERMAL BUBBLE HEATER
115: CHAMBER
120: EJECTION ELECTRODE
122: THROUGH-HOLE
124: VOLTAGE APPLICATION UNIT
130: SPACER
132: HOLE
200: EVAPORATION CONTROL UNIT
210: SPACER
212: HOLE
220: FOCUSING ELECTRODE
222: THROUGH-HOLE
224: VOLTAGE APPLICATION UNIT
230: HEATING UNIT
240: HEAT SHIELD
250: GAS SUPPLY UNIT
252: GAS SUPPLY CHANNEL

What is claimed is:

1. An ink jetting apparatus with multi-nozzles, the apparatus comprising:

a liquid droplet generating unit configured to generate liquid droplets from ink and to jet the liquid droplets through the multi-nozzles;

and an evaporation control unit configured to guide the liquid droplets jetted from the multi nozzles to protect the liquid droplets from thermal and physical disturbance and to control evaporation of the liquid droplets, the evaporation control unit comprising a spacer, a focusing electrode and a heating unit, wherein the spacer forms a path guiding the liquid droplet jetted from the liquid droplet generating unit, the focusing electrode is arranged below the spacer and has a through-hole for discharging the liquid droplets that passed though the spacer, and is configured to allow the liquid droplets to be focused to a center of the through-hole and discharged using a voltage applied, and the heating unit is formed as an electric heating plate arranged below the focusing electrode for heating the focusing electrode.

2. The apparatus according to claim 1, wherein the liquid droplet generating unit jets the liquid droplets in drop-on-demand method.

3. The apparatus according to claim 1, wherein the liquid droplet generating unit is formed as any one of an inkjet head of piezoelectric inkjet method, an inkjet head of thermal bubble method, and an inkjet head of electrostatic inkjet method.

4. The apparatus according to claim 1, wherein the liquid droplet generating unit is formed in a hybrid method that is a combined method of a piezoelectric inkjet method or a thermal bubble method and an electrostatic jet method that generates the liquid droplets using a force of an electric field caused by a voltage being applied to an electrode, wherein the electrode is formed in an ink chamber or an ink supply tube of an inkjet head of the piezoelectric inkjet method or an inkjet head of the thermal bubble method.

5. The apparatus according to claim 4, wherein the liquid droplet generating unit further comprises an ejection electrode which is arranged in a position spaced apart from the multi-nozzles in a direction in which the liquid droplets are jetted, has a through-hole where the liquid droplets jetted from the multi-nozzles penetrate and are discharged, and is configured to generate the electric field with the applied voltage to generate the liquid droplets from the ink.

6. The apparatus according to claim 5, having a ground electrode formed in the ink chamber or the ink supply tube of the inkjet head of piezoelectric inkjet method or the inkjet head of thermal bubble method.

7. The apparatus according to claim 5, comprising in the liquid droplet generating unit a spacer between the multi-nozzles and the ejection electrode, the spacer forming a path where the liquid droplets move.

8. The apparatus according to claim 7, further comprising a gas supply unit for supplying gas to an inside of the first spacer to focus the liquid droplets to a center of the path.

9. The apparatus according to claim 8, wherein the gas is supplied to the inside of the first spacer through a gas supply channel of a structure being branched off from the gas supply unit.

10. The apparatus according to claim 5, wherein the ejection electrode is branched off for each separate nozzle constituting the multi-nozzles, so that the voltage is controlled separately.

11. The apparatus according to claim 1, wherein the evaporation control unit has a plurality of sets comprising the spacer of the evaporation control unit and the focusing electrode is formed in a direction in which the liquid droplets are jetted.

12. The apparatus according to claim 11, wherein a size of the voltage being applied to the focusing electrode is controlled to increase along the direction in which the liquid droplets are jetted.

13. The apparatus according to claim 1, wherein the focusing electrode is branched off for each separate nozzle constituting the multi-nozzles so that the voltage is controlled separately.

14. The apparatus according to claim 1, wherein the heating unit is branched off for each separate nozzle constituting the multi-nozzles, to be controlled separately.

15. The apparatus according to claim 1, further comprising, between the liquid droplet generating unit and the evaporation control unit, a heat shield for shielding heat generated from the heating unit.

* * * * *